US010850513B2

(12) United States Patent
Netsu

(10) Patent No.: US 10,850,513 B2
(45) Date of Patent: Dec. 1, 2020

(54) LIQUID EJECTION HEAD AND LIQUID EJECTION APPARATUS

(71) Applicant: CANON KABUSHIKI KAISHA, Tokyo (JP)

(72) Inventor: Hiroshi Netsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/289,982

(22) Filed: Mar. 1, 2019

(65) Prior Publication Data

US 2019/0283419 A1 Sep. 19, 2019

(30) Foreign Application Priority Data

Mar. 13, 2018 (JP) ..... 2018-045169

(51) Int. Cl.

| | |
|---|---|
| ***B41J 2/14*** | (2006.01) |
| ***B41J 2/045*** | (2006.01) |
| ***B41J 2/175*** | (2006.01) |
| ***B41J 2/18*** | (2006.01) |

(52) U.S. Cl.

CPC ..... *B41J 2/14201* (2013.01); *B41J 2/04581* (2013.01); *B41J 2/14233* (2013.01); *B41J 2/175* (2013.01); *B41J 2/18* (2013.01); *B41J 2002/14362* (2013.01); *B41J 2002/14459* (2013.01); *B41J 2002/14491* (2013.01)

(58) Field of Classification Search

CPC ..... B41J 2202/12; B41J 2002/18

See application file for complete search history.

(56) References Cited

U.S. PATENT DOCUMENTS

| | | | |
|---|---|---|---|
| 8,579,412 | B2 | 11/2013 | Bibl et al. |
| 8,752,946 | B2 | 6/2014 | Wells, Jr. et al. |
| 8,789,924 | B2 | 7/2014 | Bibl et al. |
| 9,022,520 | B2 | 5/2015 | Brady et al. |
| 2010/0214334 | A1* | 8/2010 | Kusunoki et al. ... B41J 2202/12 |
| 2012/0162331 | A1 | 6/2012 | Kataoka et al. |

FOREIGN PATENT DOCUMENTS

| | | | |
|---|---|---|---|
| CN | 104245330 | A | 12/2014 |
| JP | 09-309206 | A | 12/1997 |
| JP | 2014-065313 | A | 4/2014 |

OTHER PUBLICATIONS

Office Action dated Aug. 31, 2020, in Chinese Patent Application No. 201910182209.7.

* cited by examiner

*Primary Examiner* — Juanita D Jackson
(74) *Attorney, Agent, or Firm* — Venable LLP

(57) ABSTRACT

A liquid ejection head includes a first pressure chamber row having a plurality of first pressure chambers respectively communicating with a plurality of ejection orifices that eject liquid and arranged along a predetermined direction, a second pressure chamber row having a plurality of second pressure chambers respectively communicating with a plurality of ejection orifices that eject liquid and arranged along the predetermined direction, a first flow path for supplying the liquid to the plurality of first pressure chambers, and a second flow path for recovering the liquid from the plurality of second pressure chambers. Part of the first pressure chamber row is disposed to overlap the first flow path, and part of the second pressure chamber row is disposed to overlap the second flow path, as viewed from an ejection direction of the liquid.

12 Claims, 6 Drawing Sheets

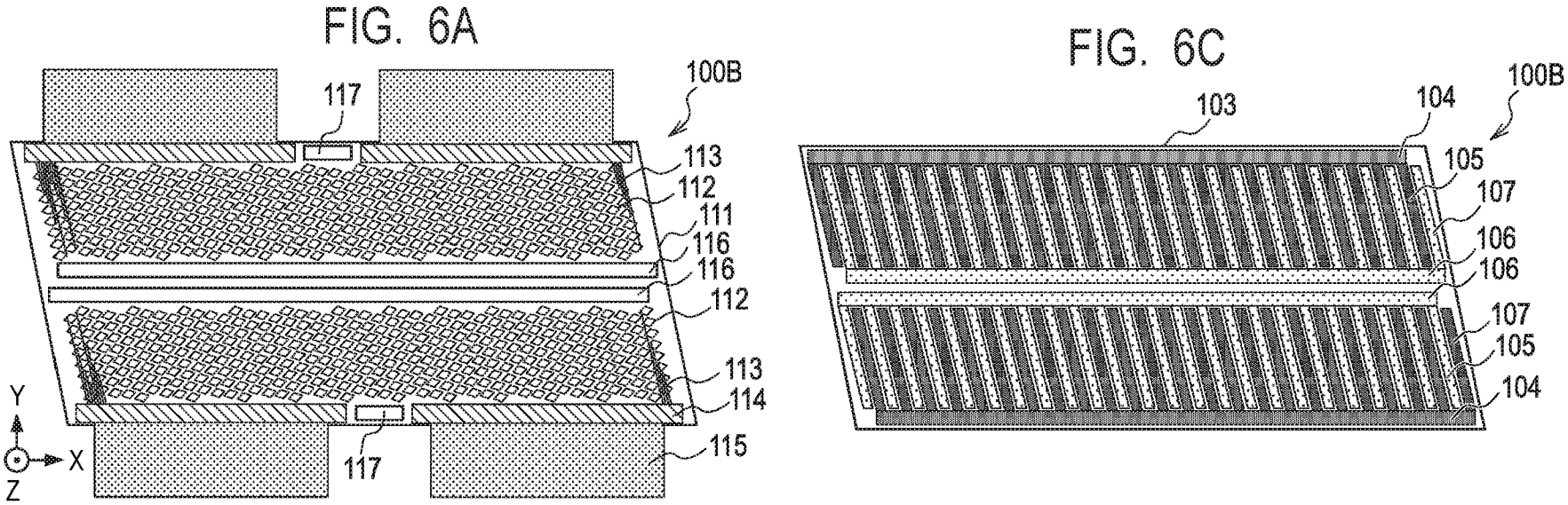
FIG. 6A
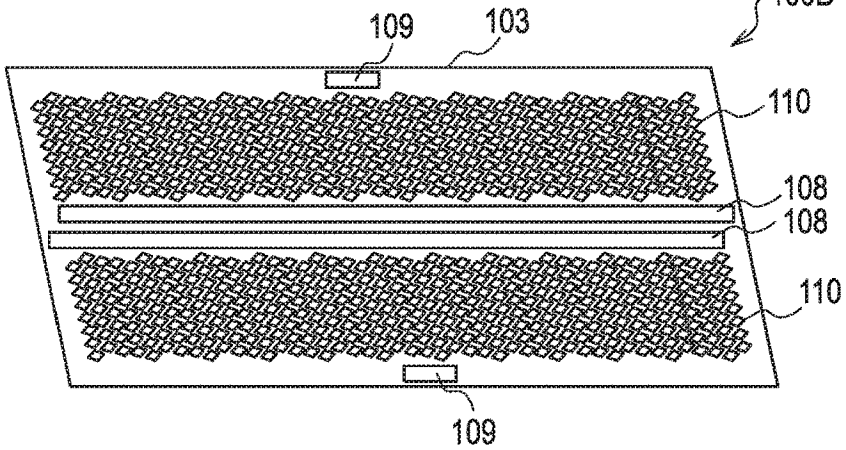
FIG. 6B
FIG. 6C
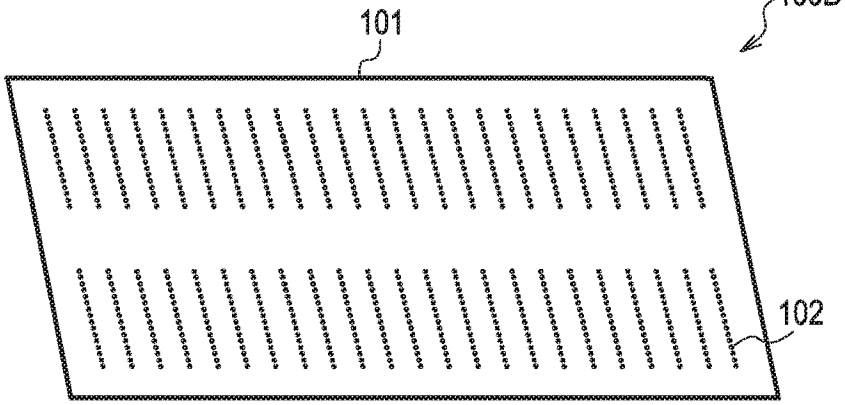
FIG. 6D

LIQUID EJECTION HEAD AND LIQUID EJECTION APPARATUS

BACKGROUND OF THE INVENTION

Field of the Invention

The present invention relates to a liquid ejection head and a liquid ejection apparatus.

Description of the Related Art

An ejection head included by an inkjet recording apparatus includes, for example, pressure chambers, piezoelectric elements that contract the pressure chambers, and a plate in which a plurality of ejection orifices are formed, and ejects ink in the pressure chambers as liquid droplets from predetermined ejection orifices by changing capacities of the pressure chambers by the piezoelectric elements. Some of the plurality of ejection orifices sometimes do not eject ink at a time of ejection operation. Ink in the ejection orifices that do not eject ink increases in viscosity because volatile components evaporate from the surface of the ink. As a result, the ejection head sometimes causes ejection failure.

To suppress the ejection failure, there is a circulation mechanism that connects the pressure chambers to a circulation channel to circulate ink in a vicinity of the ejection orifices, for example. The ejection head that adopts the circulation mechanism includes a supply flow path and a recovery flow path of ink, which configure a part of the circulation channel, in the ejection head. In order to make the ejection head adopting the mechanism compatible with high image quality, it is necessary to dispose a plurality of ejection orifices with high density. In this case, the same number of pressure chambers and piezoelectric elements of the ejection head as the number of discharge orifices are required.

The ejection head compatible with high image quality adopting the circulation mechanism has a large number of pressure chambers in addition to the supply flow path and the recovery flow path for performing circulation, so that efficient disposition of these components becomes a problem. For example, in the case of the ejection head disclosed in Japanese Patent Application Laid-Open No. 2014-65313, the pressure chambers cannot be disposed in a region where individual wirings are disposed on a surface where the piezoelectric elements are disposed, so that a plurality of ejection orifices cannot be disposed with high density.

SUMMARY OF THE INVENTION

The present invention has an object to provide a liquid ejection head in which a plurality of ejection orifices that eject liquid can be disposed with high density, in a liquid ejection head in which supply and recovery of liquid are performed.

A liquid ejection head of the present invention includes a first pressure chamber row having a plurality of first pressure chambers respectively communicating with a plurality of ejection orifices that eject liquid and arranged along a predetermined direction, a second pressure chamber row having a plurality of second pressure chambers respectively communicating with a plurality of ejection orifices that eject liquid and arranged along the predetermined direction, a first flow path for supplying the liquid to the plurality of first pressure chambers, and a second flow path for recovering the liquid from the plurality of second pressure chambers, wherein part of the first pressure chamber row is disposed to overlap the first flow path, and part of the second pressure chamber row is disposed to overlap the second flow path, as viewed from an ejection direction of the liquid.

Further features of the present invention will become apparent from the following description of exemplary embodiments with reference to the attached drawings.

BRIEF DESCRIPTION OF THE DRAWINGS

FIG. 6A is an exploded view of a head chip of a liquid ejection head of a third embodiment.

FIG. 6B is an exploded view of the head chip of the liquid ejection head of the third embodiment.

FIG. 6C is an exploded view of the head chip of the liquid ejection head of the third embodiment.

FIG. 6D is an exploded view of the head chip of the liquid ejection head of the third embodiment.

DESCRIPTION OF THE EMBODIMENTS

Preferred embodiments of the present invention will now be described in detail in accordance with the accompanying drawings.

First Embodiment

Figure 1:
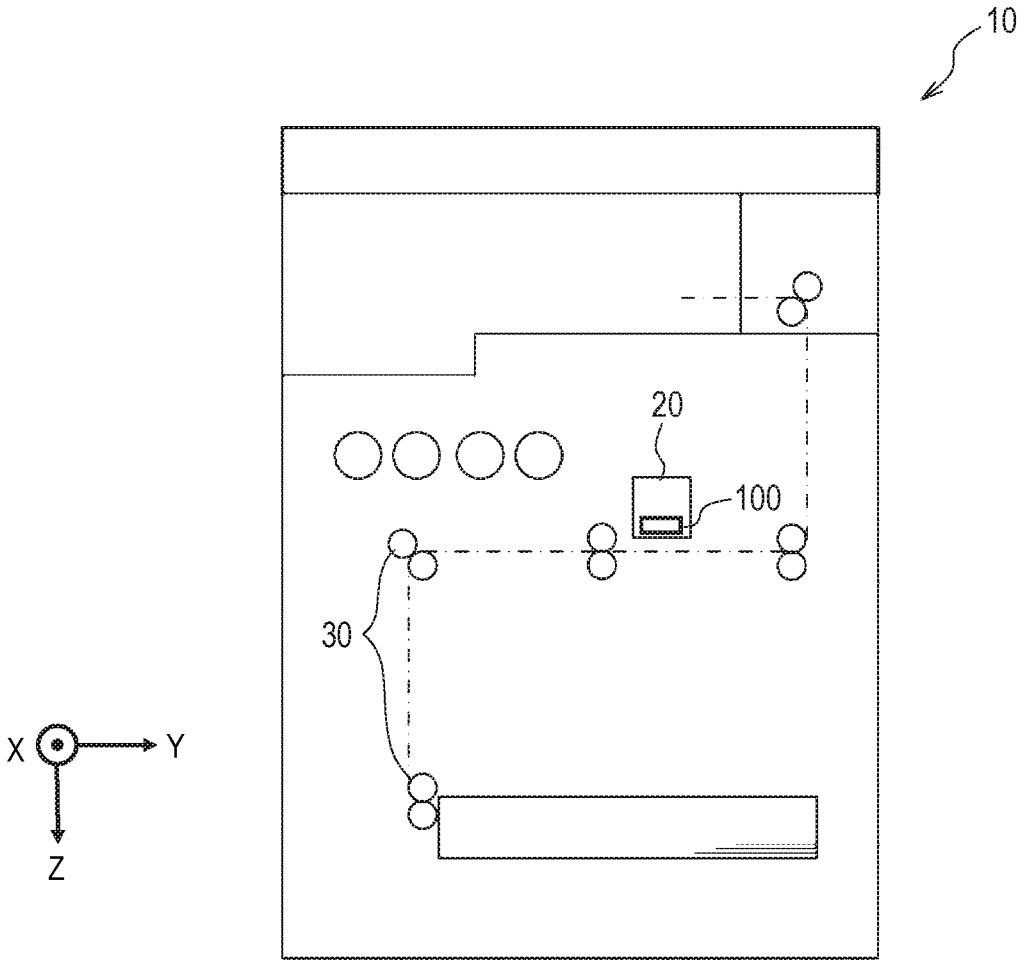
FIG. 1 is a schematic view of a liquid ejection apparatus of a first embodiment.

Hereinafter, a first embodiment and a modified example of the first embodiment will be described. FIG. 1 is a schematic view of a liquid ejection apparatus 10 of the present embodiment. The liquid ejection apparatus 10 includes a liquid ejection head 20 and a conveying section 30. The liquid ejection apparatus 10 is an inkjet type recording apparatus that forms an image on a recording medium by ejecting ink (an example of the liquid) to a recording medium (an example of the medium) to land the ink on the recording medium, as an example. The conveying section 30 conveys the recording medium to a position facing the liquid ejection head 20. Here, an example of the liquid may be other than ink.

Figure 2A:
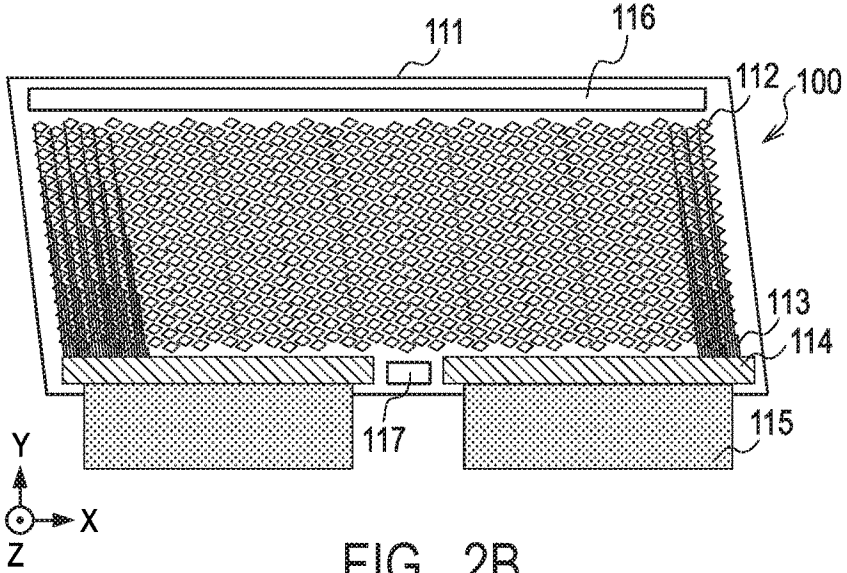
FIG. 2A is an exploded view of a head chip of a liquid ejection head of the first embodiment.
Figure 2B:
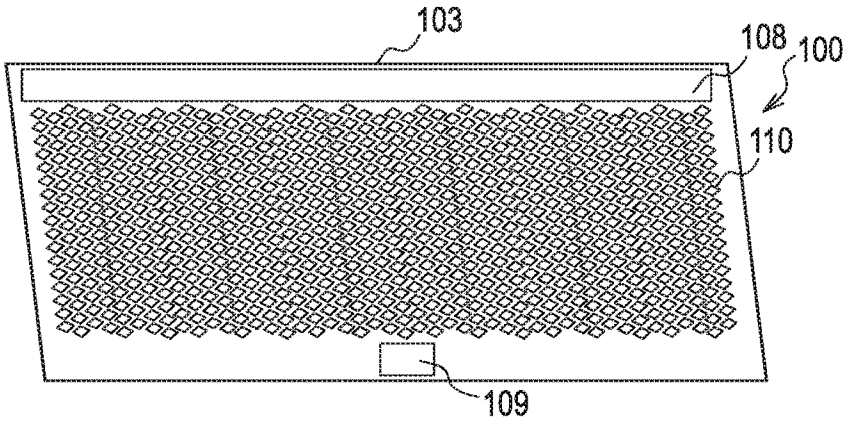
FIG. 2B is an exploded view of the head chip of the liquid ejection head of the first embodiment.
Figure 2C:
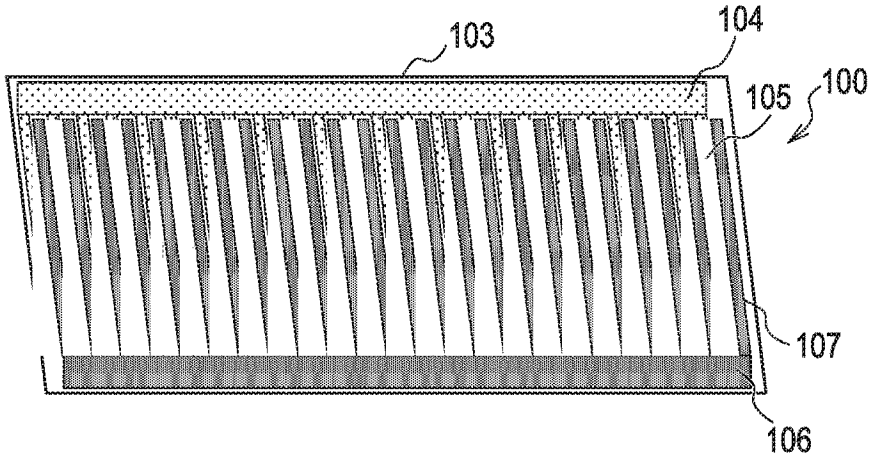
FIG. 2C is an exploded view of the head chip of the liquid ejection head of the first embodiment.
Figure 2D:
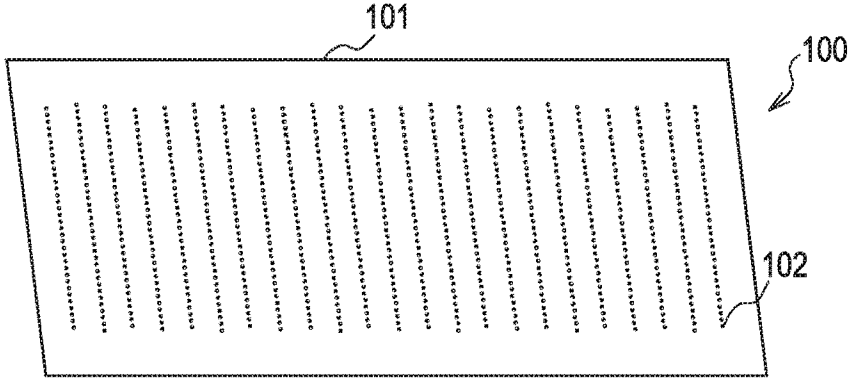
FIG. 2D is an exploded view of the head chip of the liquid ejection head of the first embodiment.

FIGS. 2A to 2D are exploded views of a head chip 100 included by the liquid ejection head 20. The head chip 100 is formed to be long, and is disposed in a state where a longitudinal direction (an X-direction in the drawings) is along a depth direction (a Y-direction in the drawings) of the liquid ejection apparatus 10. The head chip 100 is composed of a plurality of layers, and respective layers illustrated in FIGS. 2A to 2D are views from a side opposite to an ink ejection direction side by respective ejection orifices 102. In the respective layers illustrated in FIGS. 2A to 2D, parts invisible from outside in the respective layers are also illustrated to facilitate explanation of the respective layers. FIG. 2D is a view of an orifice plate 101 in which the plurality of ejection orifices 102 for ejecting ink are formed, viewed from a side (an undersurface side that will be described later) where the ink is ejected.

FIG. 2C is a view of a flow path forming layer 103 made by processing silicon or the like, viewed from an orifice plate 101 side. In the flow path forming layer 103, a common supply flow path 104 (an example of a supply flow path), a plurality of supply branch flow paths 105 (an example of a first flow path), a common recovery flow path 106 (an example of a recovery flow path), and a plurality of recovery branch flow paths 107 (an example of a second flow path) are formed. The common supply flow path 104, the plurality of supply branch flow paths 105, the common recovery flow path 106 and the plurality of recovery branch flow paths 107 are respectively formed in linear flow paths. The common supply flow path 104 is disposed at one end side in a short-side direction of the head chip 100 in a state along a longitudinal direction (an example of a crossing direction to cross from a predetermined direction) of the head chip 100. The common supply flow path 104 is a flow path for supplying ink to the plurality of supply branch flow paths 105. The common recovery flow path 106 is disposed at the other end side in the short-side direction of the head chip 100 in a state along the longitudinal direction of the head chip 100. The common recovery flow path 106 is a flow path for recovering ink from the plurality of recovery branch flow paths 107. The respective flow paths of the plurality of supply branch flow paths 105 and the plurality of recovery branch flow paths 107 are disposed in a state where the supply branch flow paths 105 and the recovery branch flow paths 107 are alternately arranged, along the short-side direction (one example of the predetermined direction) of the head chip 100, respectively. The common supply flow path 104 communicates with the plurality of supply branch flow paths 105 at one end side of the supply branch flow paths 105. The common recovery flow path 106 communicates with the plurality of recovery branch flow paths 107 at the other end side of the supply branch flow paths 105.

FIG. 2B is a view of the flow path forming layer 103 viewed from a side opposite to the orifice plate 101 side. At the side opposite to the orifice plate 101 side in the flow path forming layer 130, a supply hole 108, a recovery hole 109 and pressure chambers 110 corresponding to the ejection orifices 102 are formed. The supply hole 108 communicates with the common supply flow path 104. The recovery hole 109 communicates with the common recovery flow path 106. Hereinafter, explanation will be made with a surface at the orifice plate 101 side in the flow path forming layer 103 set as an "undersurface," and a surface at the opposite side to the orifice plate 101 in the flow path forming layer 103 set as a "top surface."

As illustrated in FIG. 2A, on the actuator layer 111, piezoelectric elements 112 are disposed correspondingly to the pressure chambers 110 that are formed in the top surface of the flow path forming layer 103. Therefore, the actuator layer 111 is made long. Further, at one end side in a short-side direction of the actuator layer 111, a supply hole 116 (an example of a first through hole) is formed, and at the other end side, a recovery hole 117 (an example of a second through hole) is formed. In other words, in the actuator layer 111, two through holes are formed, and one is the supply hole 116, whereas the other one is the recovery hole 117. The recovery hole 117 is a through hole that communicates with the recovery hole 109 of the flow path forming layer 103. The recovery hole 117 is made to be narrower in width with an opening area smaller than the supply hole 116. That is, the recovery hole 117 is made a through hole smaller in sectional area than the supply hole 116. A driving IC 114 is mounted on a region at the other end side in the short-side direction of the head chip 100, that is, on a region other than the recovery hole 117 in a region on the common recovery flow path 106. The actuator layer 111 is disposed on a top surface of the flow path forming layer 103 (refer to FIG. 4B). Further, a part of the actuator layer 111 is composed of a vibration plate 205 that will be described later and a plurality of piezoelectric elements 112.

Individual wirings 113 connected to the individual piezoelectric elements 112 are led out to the other end side in the short-side direction of the head chip 100, that is, a side where the recovery hole 117 is formed, to be connected to the driving IC 114. To the driving IC 114, a flexible printed circuit (FPC) that transmits signals for driving the piezoelectric elements 112 to eject ink is connected.

The ink to be ejected from the respective ejection orifices 102 is supplied to the common supply flow path 104 from the supply hole 116 connected to an outside, and further passes through the respective supply branch flow paths 105 from the common supply flow path 104 to be supplied to the respective pressure chambers 110.

An ejection control signal from a control section (not illustrated) included in the liquid ejection apparatus 10 is transmitted to the driving IC 114 via the FPC 115, and a voltage waveform for ejection driving, which is outputted from the driving IC 114, is applied to the respective piezoelectric elements 112 through the respective individual wirings 113. As a result, the respective pressure chambers 110 are expanded and contracted by the respective piezoelectric elements 112, that is, capacities of the respective pressure chambers 110 are changed, whereby the ink is ejected from the respective ejection orifices 102. In relation to this, of the ink that is supplied to the respective pressure chambers 110, the ink that is not ejected passes through the common recovery flow path 106 via the recovery branch flow path 107 and is discharged to an outside of the head chip 100 from the recovery hole 117 to be recovered. The outside is a circulation channel (not illustrated) as an example, and to the circulation channel, an ink tank (not illustrated) that houses the ink to be supplied to the head chip 100 is connected. That is, the head chip 100 of the present embodiment is connected to the circulation channel to which the ink tank is connected, so that the ink flows from the outside via the supply hole 116, and the ink flows to the outside via the recovery hole 117.

A steady flow of the ink like this is effective for preventing ejection failure of the liquid ejection head 20 caused by increase in viscosity of the ink that occurs after a volatile component of the ink evaporates from an ink surface in the ejection orifices 102 in a period in which the predetermined ejection orifices 102 do not eject ink. A configuration may be adopted, in which the direction in which the ink flows in the steady flow is made such that the recovery hole 117 with a small opening area is made the supply hole, and the supply hole 116 with a large opening area is made the recovery hole, that is, the direction in which the ink flows is made an opposite direction. For example, when the ink is ejected continuously from the large number of ejection orifices 102 in addition to the steady flow, a large amount of ink needs to be supplied. In this case, a configuration may be adopted, in which the ink can be supplied by being passed inversely from the supply hole 116 that is used as the recovery hole with the large opening area and small flow resistance.

Figure 3A:
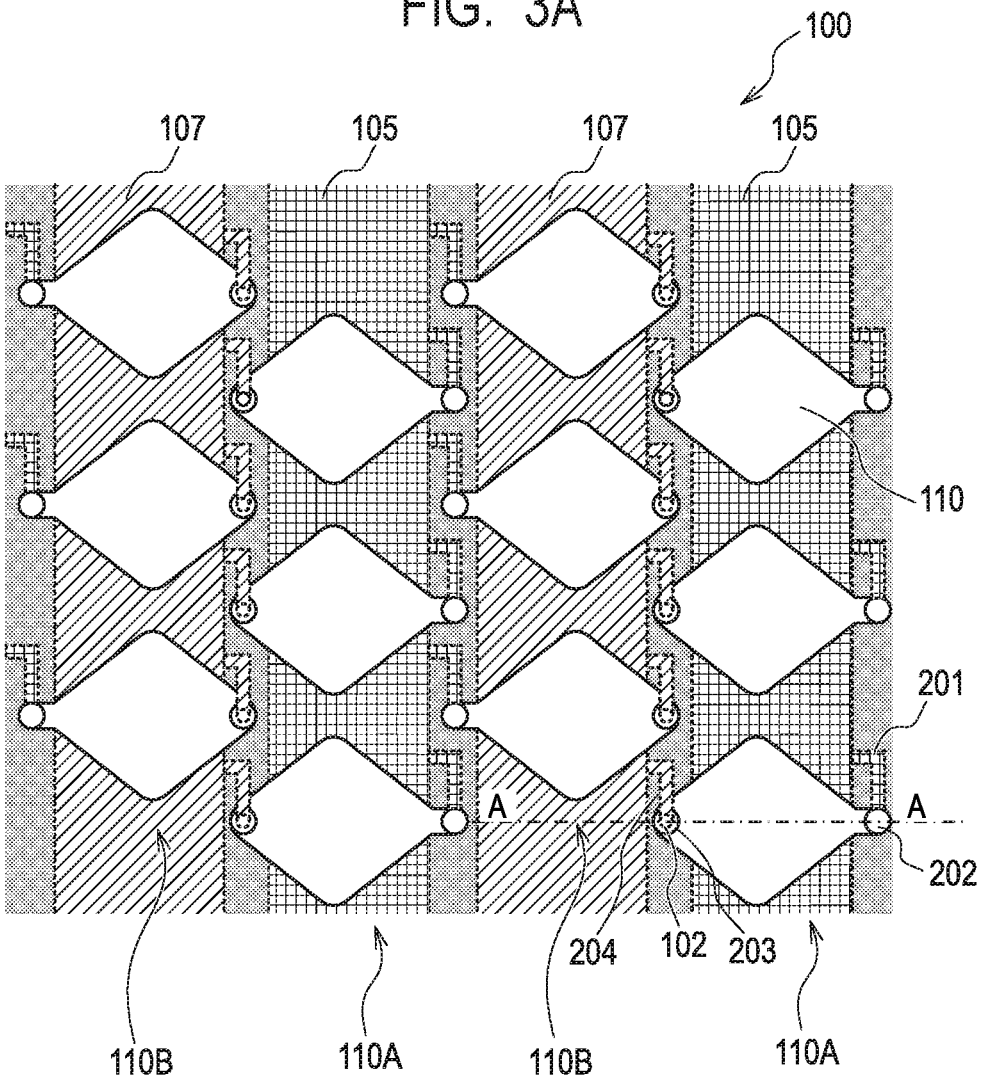
FIG. 3A is a partially enlarged view of the head chip of the first embodiment.
Figure 3B:
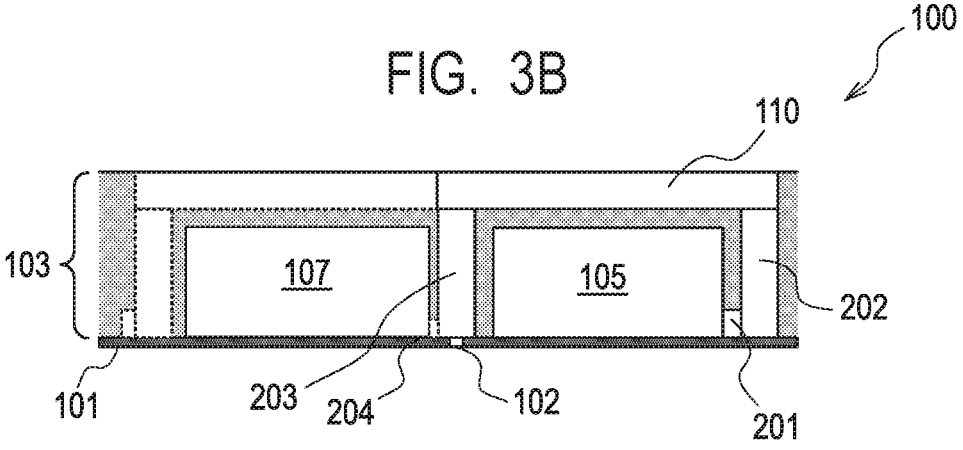
FIG. 3B is a partially enlarged view of the head chip of the first embodiment, and is a view illustrating an A-A section in FIG. 3A.

FIGS. 3A and 3B are partially enlarged views of the head chip 100 in FIGS. 2A to 2D. Hereinafter, a positional relationship of the supply branch flow paths 105, the recovery branch flow paths 107 and the pressure chambers 110 and connection of the respective flow paths will be described in detail.

FIG. 3A is a partially enlarged view of the head chip 100 viewed from an upper side, with the actuator layer 111 excluded from the head chip 100. FIG. 3A also illustrates parts invisible from outside to facilitate explanation of FIG. 3A. FIG. 3B illustrates an A-A section in FIG. 3A.

Figure 4A:
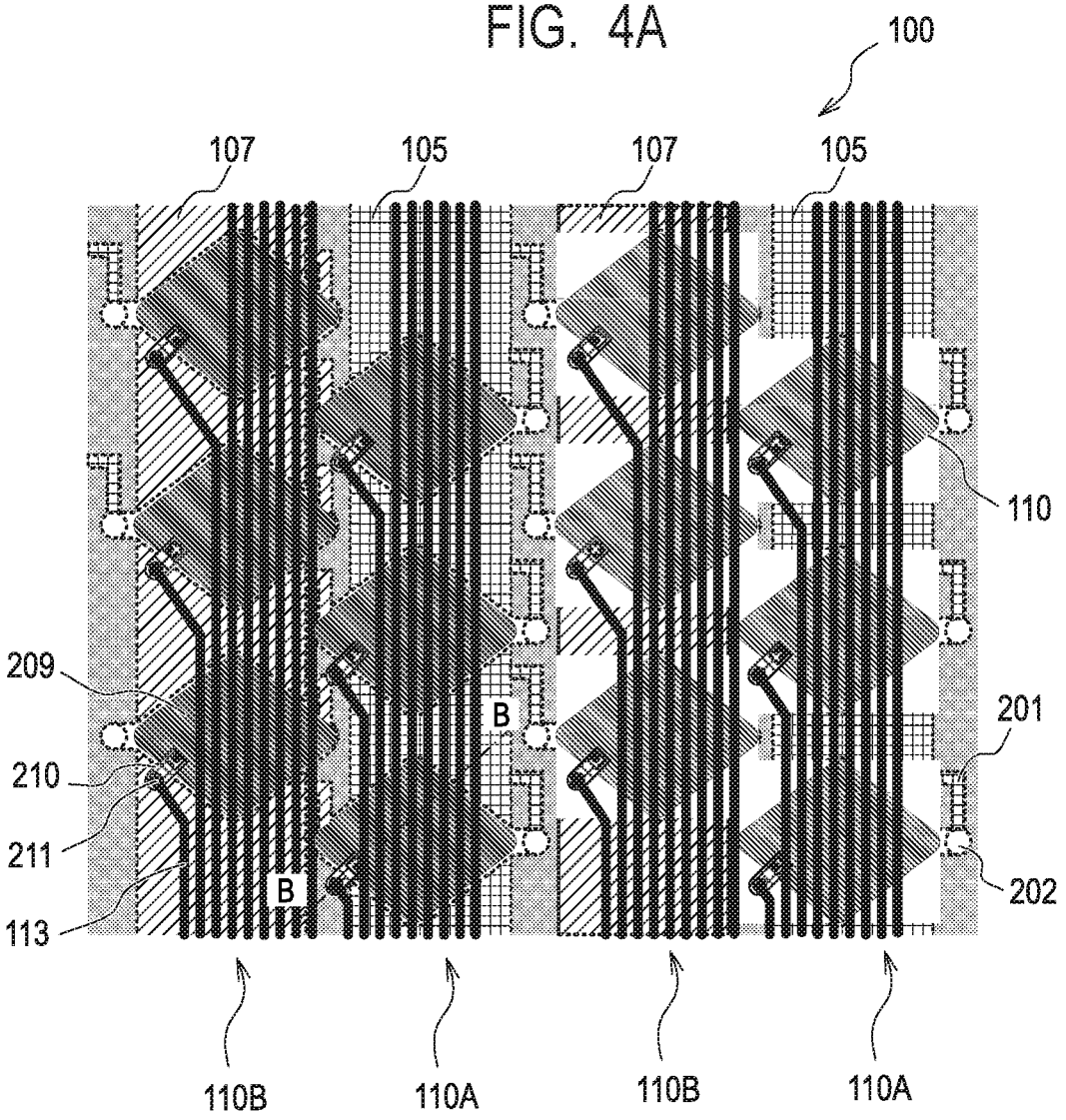
FIG. 4A is a partially enlarged view of another head chip of the first embodiment.

As illustrated in FIG. 3A, in the flow path forming layer 103, the supply branch flow paths 105 and the recovery branch flow paths 107 are respectively disposed alternately in parallel. In the supply branch flow path 105, some of the plurality of pressure chambers 100 are disposed to overlap one another in a thickness direction of the flow path forming layer 103 (the ejection direction of the ink ejected from the ejection orifices 102, the Z-direction in the drawing). Further, in the recovery branch flow path 107, some of the plurality of pressure chambers 110 are disposed to overlap one another in the thickness direction of the flow path forming layer 103. Here, the respective pressure chambers 110 that are arranged to form a row and overlap one another in the supply branch flow path 105 are set as first pressure chambers, and a group configured by the first pressure chambers forming the row is set as a first pressure chamber row 110A. The respective pressure chambers 110 that are arranged to form a row and overlap one another in the recovery branch flow path 107 are set as second pressure chambers, and a group configured by the second pressure chambers forming the row is set as a second pressure chamber row 110B. As illustrated in FIGS. 3A and 4A, first sides in the X-direction of the plurality of first pressure chambers that configure the first pressure chamber row 110A are connected to the supply branch flow path 105, and second sides are connected to the recovery branch flow path 107. First sides in the X-direction of the plurality of second pressure chambers that configure the second pressure chamber row 110B are connected to the recovery branch flow path 107 and second sides are connected to the supply branch flow path 105. That is, the plurality of first pressure chambers and the plurality of second pressure chambers have a relationship in which connection positions with the supply branch flow path 105 and the recovery branch flow path 107 are in opposite directions in the X-direction, respectively.

The ink passes through a supply connection flow path 201 from the supply branch flow path 105, thereafter further passes through a supply through hole 202, and is supplied to the pressure chamber 110. A supply connection flow path 201 and a supply through hole 202 are used as throttle flow path. The supply through hole 202 is formed to penetrate through the flow path forming layer 103 in a thickness direction of the flow path forming layer 103. The supply connection flow path 201 and the supply through hole 202 are configured so that pressure in the pressure chamber 110 at a time of the pressure chamber 110 being contracted at the time of ink ejection does not escape to a supply flow path side (supply branch flow path 105 side). More specifically, in the supply connection flow path 201 and the supply through hole 202, flow path sectional areas are set to be smaller than a flow path sectional area of the pressure chamber 110 in order to increase the flow resistance, and lengths are formed to be long to increase inertance, respectively.

A feed through hole 203 is formed at a side opposite to the supply through hole 202 with the supply branch flow path 105 sandwiched between the feed through hole 203 and the supply through hole 202, that is, at a side opposite to the ink supply side of the pressure chamber 110. The feed through hole 203 communicates with the pressure chamber 110, penetrates through the flow path forming layer 103 to the orifice plate 101 side from the pressure chamber 110 side, and communicates with the ejection orifice 102.

In a portion at an undersurface side (orifice plate 101 side) in the flow path forming layer 103, a throttle flow path 204 that causes the feed through hole 203 and the recovery branch flow path 107 to communicate with each other is formed. The throttle flow path 204 is configured so that the pressure in the pressure chamber 110 at the time of the pressure chamber 110 being contracted at the time of ink ejection does not escape to the supply flow path side (supply branch flow path 105 side) like the supply connection flow path 201 and the supply through hole 202. That is, in the throttle flow path 204, a flow path sectional area thereof is set to be smaller than the flow path sectional area of the pressure chamber 110 (the flow resistance is set to be larger than the pressure chamber 110), and a length is formed to be long to increase inertance.

Figure 4B:
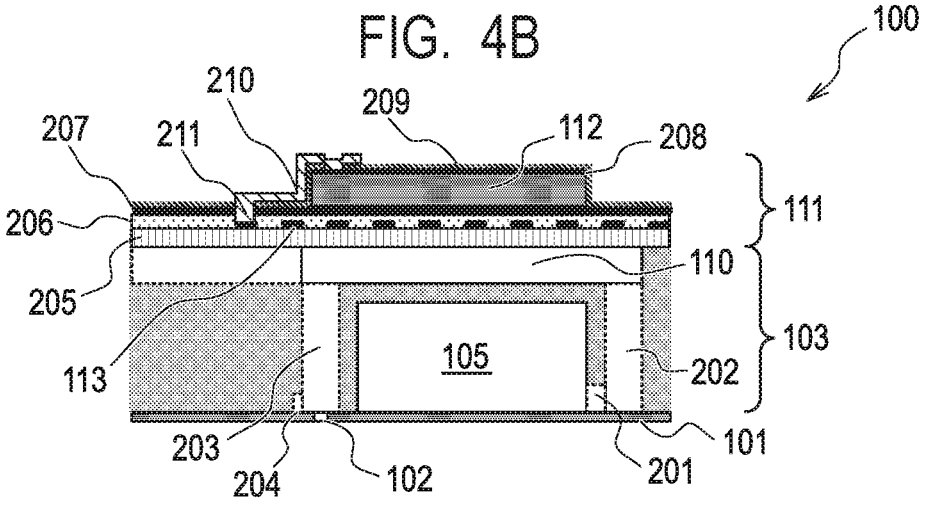
FIG. 4B is a partially enlarged view of the other head chip of the first embodiment, which is a view illustrating a B-B section in FIG. 4A.

FIG. 4A is a partially enlarged view of the head chip 100 viewed from a top surface side. FIG. 4A also illustrates parts invisible from outside in order to facilitate explanation thereof. FIG. 4B illustrates a B-B section in FIG. 4A.

A joining portion with the flow path forming layer 103 in the actuator layer 111 is a vibration plate 205 made of SiN or the like. In the present embodiment, the vibration plate 205 forms parts of walls of the respective pressure chambers 110. A plurality of individual wirings 113 that are connected to the respective piezoelectric elements 112 are disposed on an upper side of the vibration plate 205. An insulation layer 206 made from $SiO_2$ or the like is formed on the vibration plate 205 and the plurality of individual wirings 113. On the insulation layer 206, a common electrode 207 that is connected to first surfaces of the plurality of piezoelectric elements 112 and is used as a common electrode of the plurality of piezoelectric elements 112 is formed.

On an upper side of the common electrode 207, the piezoelectric elements 112 are disposed correspondingly to the respective pressure chambers 110. On the respective piezoelectric chambers 112, individual electrodes 208 are formed. The respective individual electrodes 208 are covered with an insulation layer 209.

One hole is opened in each of the insulation layer 209 on the individual electrode 208, and a layered body composed of the insulation layer 206 on the individual wirings 113, the common electrode 207 and the insulation layer 209. The hole in the layered body is a through hole 211. The individual electrode 208 and the individual wiring 113 are connected by the connection electrode 210. The common electrode 207 and the individual wiring 113 are led out to the end portion (the other end side) in the short-side direction of the head chip 100 and are respectively connected to the driving IC 114. (Refer to FIG. 4A and FIG. 2A). Then, the waveform of the driving voltage for ink ejection from the driving IC 114 is applied to the piezoelectric element 112 to bend the vibration plate 205, and the volume of the pressure chamber 110 expands and contracts, whereby the ink is ejected from the ejection orifice 102.

As illustrated in FIGS. 4A and 4B, in the present embodiment, the individual wirings 113 are disposed between the vibration plate 205 and the common electrode 207. However, a configuration may be adopted, in which the connection electrode 210 is directly adopted as the individual wiring, and is led out to the end portion of the head chip 100 from the insulation layer 209 on the piezoelectric element 112. The individual electrodes 208 and 113 can be disposed between the plurality of piezoelectric elements 112 and the vibration plate 205 and on one side or both sides at a side opposite to the vibration plate 205 with the plurality of piezoelectric elements 112 therebetween.

As above, part of the first pressure chamber row 110A is disposed to overlap the first flow path, and part of the second pressure chamber row 110B is disposed to overlap the second flow path, viewed from the ink ejection direction. That is, in the case of the present embodiment the supply branch flow path 105 and the recovery branch flow path 107 are overlapped with the pressure chambers 110 in the ink ejection direction. Consequently, according to the present embodiment, in the liquid ejection head 20 in which supply and recovery of the ink are performed, a plurality of ejection orifices 102 can be disposed with high density.

Further, in the present embodiment, a plurality of individual wirings 113 are disposed to overlap the pressure chambers 110 as viewed from the ink ejection direction. More specifically, the plurality of individual wirings 113 are disposed to overlap the respective piezoelectric elements 112. Consequently, according to the present embodiment, in the liquid ejection head 20 in which supply and recovery of the ink are performed, the plurality of ejection orifices 102 can be disposed with high density.

Second Embodiment

Next, concerning a second embodiment, a different part from the aforementioned first embodiment will be described with reference to FIGS. 5A to 5B. Hereinafter, in the present embodiment, the same components as in the first embodiment will be described by using the same reference signs.

In the first embodiment, the flow path forming layer 103 is formed so that the pressure chambers 110 forming the single rows, that is, the first pressure chamber row 110A and the second pressure chamber row 110B, overlap each of the supply branch flow paths 105 and each of the recovery branch flow paths 107 (FIGS. 3A and 3B and FIGS. 4A and 4B). In contrast with this, in the present embodiment, a width of each of the supply branch flow paths 105 and each of the recovery branch flow paths 107 is wider than the width in the case of the first embodiment. In the present embodiment, the first pressure chamber row 110A and the second pressure chamber row 110B, which are disposed adjacently to each other, configure a group forming two rows (hereinafter, referred to as a pressure chamber group 110C). In other words, a head chip 110A of the present embodiment has a plurality of pressure chamber groups 110C, in each of which the first pressure chamber row 110A and the second pressure chamber row 110B are adjacent to each other to form two rows. A plurality of pressure chamber groups 110C are made, and some of the plurality of pressure chamber groups 110C are respectively disposed to overlap the supply branch flow path 105 and the recovery branch flow path 107, as viewed from the ink ejection direction.

Figure 5A:
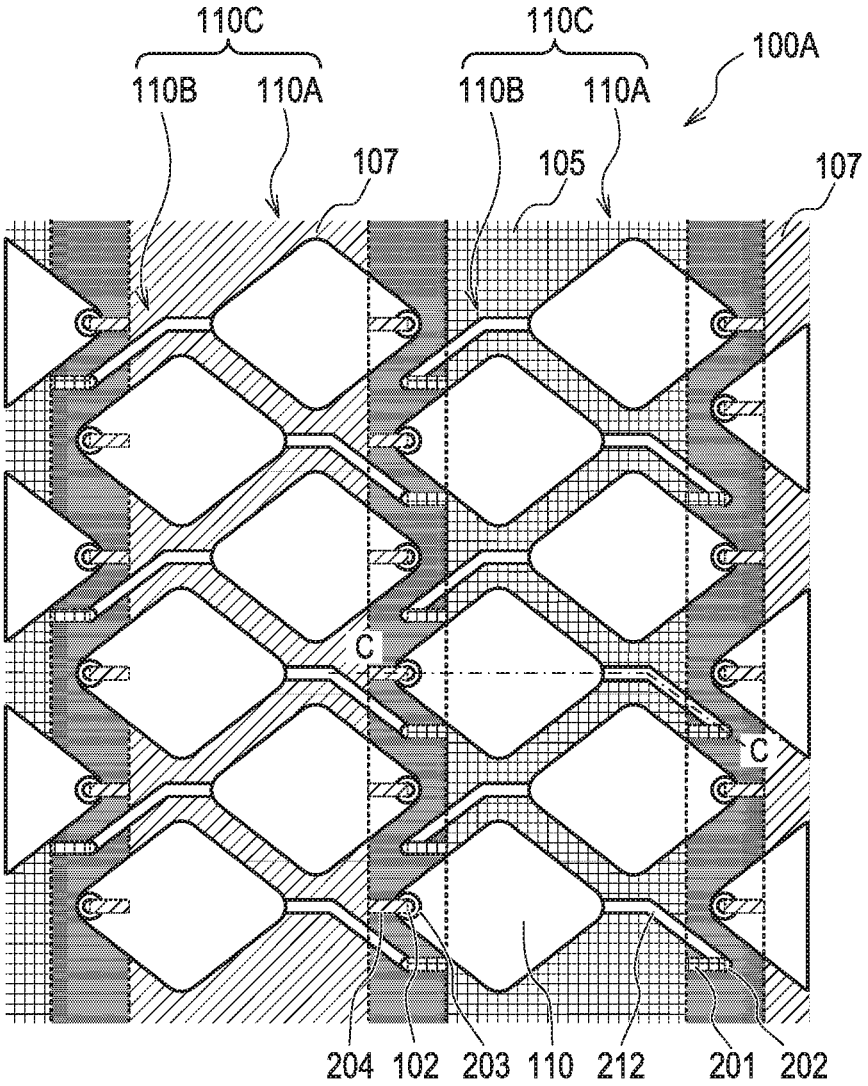
FIG. 5A is a partially enlarged view of a head chip of a second embodiment.
Figure 5B:
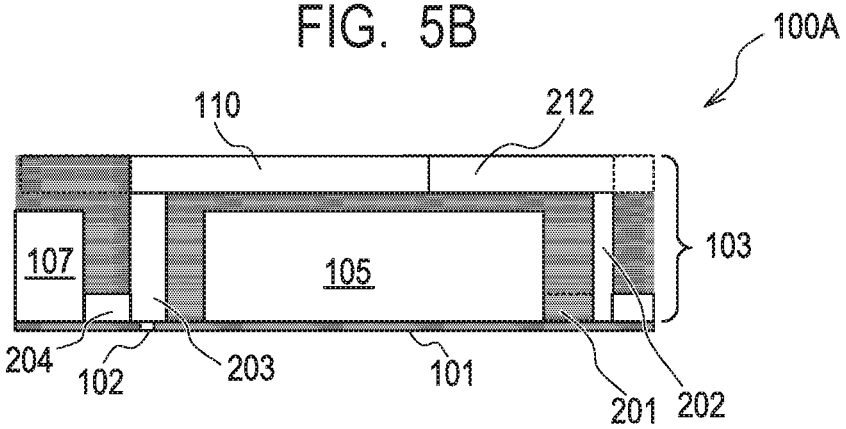
FIG. 5B is a partially enlarged view of the head chip of the second embodiment, which is a view illustrating a B-B section in FIG. 5A.

FIGS. 5A and 5B are views in which a part of the head chip 100A of the present embodiment is enlarged. FIG. 5A is a partially enlarged view of the head chip 100A viewed from a top surface side, with the actuator layer 111 excluded from the head chip 100A. FIG. 5A also illustrates parts invisible from outside in order to facilitate explanation thereof. FIG. 5B illustrates a B-B section in FIG. 5A.

As illustrated in FIG. 5A, in the flow path forming layer 103, the supply branch flow path 105 and the recovery branch flow path 107 are respectively disposed parallel and alternately. In the supply branch flow path 105, the pressure chamber group 110C is formed on a top surface of the flow path forming layer 103. Of the pressure chamber group 110C, the respective pressure chambers 110 configuring the first pressure chamber row 110A and the respective pressure chambers 110 configuring the second pressure chamber row 110B are disposed in a state facing opposite directions from each other. In other words, a plurality of first pressure chambers and a plurality of second pressure chambers respectively have a relationship in which connection positions with the supply branch flow path 105 and the recovery branch flow path 107 are in opposite directions in the X-direction.

In the present embodiment, a flow resistance of a flow path from the supply branch flow path 105 to the recovery branch flow path 107 through the first pressure chamber, and a flow resistance of a flow path from the supply branch flow path 105 to the recovery branch flow path 107 through the second pressure chamber are set to be substantially equal (substantially the same). Accordingly, in the present embodiment, an ejection characteristic of the ink that is ejected via the respective first pressure chambers of the first pressure chamber row 110A, and an ejection characteristic of the ink that is ejected via the respective second pressure chambers of the second pressure chamber row 110B are substantially made equal easily. Further, the present embodiment can reduce the flow resistance of the branch flow paths as the widths of the respective supply branch flow paths 105 and the respective recovery branch flow paths 107 can be made wider, as compared with the first embodiment. Further, the present embodiment is capable of setting the supply connection flow path 212 to be longer as compared with the first embodiment, and therefore can make it difficult for the pressure occurring in the pressure chambers 110 at the time of ink ejection to escape to the ink supply side.

Third Embodiment

Next, concerning a third embodiment, a part different from the first embodiment and the second embodiment mentioned above will be described with reference to FIGS. 6A to 6D. Hereinafter, in the present embodiment, the same components as in the first embodiment will be described by using the same reference signs.

The present embodiment is configured to supply and eject different kinds of inks (two kinds of inks as an example). More specifically, a head chip 100B of the present embodiment is configured such that two head chips 100 in the first embodiment are aligned in a state where mutual first end sides (supply hole 116 sides) in the short-side direction are adjacent to each other, and integrally formed (refer to FIGS. 2A to 2D, and FIGS. 6A to 6D).

According to the above configuration, the present embodiment can supply and eject two kinds of inks, for example, inks of different colors, with one head chip 100B.

As above, the first to third embodiments are described as examples, but the mode included in the technical range of the present disclosure is not limited to the first to the third embodiments.

For example, the head chip 100B of the third embodiment is described as the configuration equivalent to the combination of the two head chips 100 of the first embodiment. However, as a modified example of the third embodiment, a combination of two of the head chips 100A of the second embodiment may be adopted, for example. Further, as another modified example of the third embodiment, a configuration equivalent to a combination of two head chips composed of the head chip 100 of the first embodiment and the head chip 100A of the second embodiment may be adopted, for example.

Each of the embodiments is described such that deformation of the respective pressure chambers 110 is performed by the piezoelectric elements 112 such as PZT. However, a heater (not illustrated) may be used, in place of the piezoelectric elements 112 and the vibration plate 205.

In the second embodiment, the flow resistance of the flow path from the supply branch flow path 105 to the first pressure chamber and the flow path from the first pressure chamber to the recovery branch flow path 107, and the flow resistance of the flow path from the supply branch flow path 105 to the second pressure chamber and the flow path from the second pressure chamber to the recovery branch flow path 107 are set as substantially equal. In the first embodiment and the third embodiment, the above described setting of the second embodiment may be adopted.

According to the liquid ejection head of the present disclosure, in the liquid ejection head in which supply and recovery of the liquid are performed, the plurality of ejection orifices that eject a liquid can be disposed with high density.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-045169, filed Mar. 13, 2018, which is hereby incorporated by reference herein in its entirety.

What is claimed is:

1. A liquid ejection head, comprising:

a first pressure chamber row in which a plurality of first pressure chambers communicating with ejection orifices that eject liquid are arranged along a predetermined direction;

a second pressure chamber row in which a plurality of second pressure chambers communicating with ejection orifices that eject liquid are arranged along the predetermined direction;

a first flow path for supplying the liquid to the plurality of first pressure chambers; and a second flow path for recovering the liquid from the plurality of second pressure chambers, wherein a part of the first pressure chamber row is disposed to overlap the first flow path, as viewed from an ejection direction of the liquid, a part of the second pressure chamber row is disposed to overlap the second flow path, part of walls of the first pressure chambers and the second pressure chambers is formed of a vibration plate, a plurality of piezoelectric elements are disposed in the vibration plate outside of the first pressure chambers and the second pressure chambers and vibrate the vibration plate to change capacities of the plurality of first pressure chambers and the plurality of second pressure chambers, respectively, a plurality of individual wirings are connected to the plurality of piezoelectric elements, the plurality of individual wirings are disposed between the plurality of piezoelectric elements and the vibration plate, and on one side or both sides at a side opposite to the vibration plate with the plurality of piezoelectric elements disposed therebetween, an actuator layer is formed with the vibration plate and the piezoelectric elements being parts of the actuator layer, a first through-hole is formed at one end side in a short-side direction of the actuator layer, and a second through-hole smaller in sectional area than the first through-hole is formed at the other end side, one of the first through-hole and the second through-hole is a supply hole communicating with the first flow path, and the other of the first through-hole and the second through-hole is a recovery hole communicating with the second flow path, and the individual wirings are led out to a side where the second through-hole is formed in the short-side direction.

2. The liquid ejection head according to claim 1, further comprising:

a plurality of driving ICs for driving the plurality of piezoelectric elements, wherein the plurality of driving ICs are connected to the individual wirings.

3. The liquid ejection head according to claim 1, wherein the plurality of first pressure chambers and the first flow path are caused to communicate with each other by a throttle flow path having a greater flow resistance than that of the first pressure chambers.

4. The liquid ejection head according to claim 1, wherein the plurality of second pressure chambers and the second flow path are caused to communicate with each other by a throttle flow path having a greater flow resistance than that of the second pressure chambers.

5. The liquid ejection head according to claim 1, wherein the first flow path and the second flow path are formed to be part of a circulation channel.

6. A liquid ejection apparatus comprising:

a liquid ejection head according to claim 1; and a conveying section that conveys a medium to a position facing the liquid ejection head.

7. A liquid ejection head comprising:

a first pressure chamber row in which a plurality of first pressure chambers communicating with ejection orifices that eject liquid are arranged along a predetermined direction;

a second pressure chamber row in which a plurality of second pressure chambers communicating with ejection orifices that eject liquid are arranged along the predetermined direction;

a first flow path for supplying the liquid to the plurality of first pressure chambers; and a second flow path for recovering the liquid from the plurality of second pressure chambers, wherein a part of the first pressure chamber row is disposed to overlap the first flow path, as viewed from an ejection direction of the liquid, a part of the second pressure chamber row is disposed to overlap the second flow path, the first flow path and the second flow path respectively comprise a plurality of linear flow paths along the predetermined direction, the plurality of first flow paths and the plurality of second flow paths are disposed alternately along a crossing direction crossing the predetermined direction, a supply flow path formed in a linear shape supplies liquid to the plurality of first flow paths, a recovery flow path formed in a linear shape recovers liquid from the plurality of second flow paths, the supply flow path is disposed along the crossing direction, and communicates with the plurality of first flow paths at first end sides of the first flow paths, and the recovery flow path is disposed along the crossing direction, and communicates with the plurality of second flow paths at second end sides of the first flow paths.

8. The liquid ejection head according to claim 7, wherein part of walls of the first pressure chambers and the second pressure chambers is formed of a vibration plate, a plurality of piezoelectric elements are disposed outside of the first pressure chambers and the second pressure chambers, in the vibration plate, and vibrate the vibration plate to change capacities of the plurality of first pressure chambers and the plurality of second pressure chambers, respectively, a plurality of individual wirings are connected to the plurality of piezoelectric elements, and the plurality of individual wirings are disposed between the plurality of piezoelectric elements and the vibration plate, and on one side or both sides at a side opposite to the vibration plate with the plurality of piezoelectric elements disposed therebetween.

9. The liquid ejection head according to claim 8, further comprising:

an actuator layer with the vibration plate and the piezoelectric elements being parts of the actuator layer, wherein a first through-hole is formed at one end side in a short-side direction of the actuator layer, and a second through-hole smaller in sectional area than the first through-hole is formed at the other end side, one of the first through-hole and the second through-hole is a supply hole communicating with the first flow path, and the other of the first through-hole and the second through-hole is a recovery hole communicating with the second flow path, and the individual wirings are led out to a side where the second through-hole is formed in the short-side direction.

10. A liquid ejection head comprising:

a first pressure chamber row in which a plurality of first pressure chambers communicating with ejection orifices that eject liquid are arranged along a predetermined direction;

a second pressure chamber row in which a plurality of second pressure chambers communicating with ejection orifices that eject liquid are arranged along the predetermined direction;

a first flow path for supplying the liquid to the plurality of first pressure chambers; and a second flow path for recovering the liquid from the plurality of second pressure chambers, wherein a part of the first pressure chamber row is disposed to overlap the first flow path, as viewed from an ejection direction of the liquid, a part of the second pressure chamber row is disposed to overlap the second flow path, the plurality of first pressure chambers are connected to the second flow path, the plurality of second pressure chambers are connected to the first flow path, and in a crossing direction crossing the predetermined direction, first sides of the plurality of first pressure chambers are connected to the first flow path while second sides are connected to the second flow path, and first sides of the plurality of second pressure chambers are connected to the second flow path while second sides are connected to the first flow path.

11. A liquid ejection head comprising:

a first pressure chamber row in which a plurality of first pressure chambers communicating with ejection orifices that eject liquid are arranged along a predetermined direction;

a second pressure chamber row in which a plurality of second pressure chambers communicating with ejection orifices that eject liquid are arranged along the predetermined direction;

a first flow path for supplying the liquid to the plurality of first pressure chambers; and a second flow path for recovering the liquid from the plurality of second pressure chambers, wherein a part of the first pressure chamber row is disposed to overlap the first flow path, as viewed from an ejection direction of the liquid, a part of the second pressure chamber row is disposed to overlap the second flow path, the plurality of first pressure chambers are connected to the second flow path, the plurality of second pressure chambers are connected to the first flow path, and a flow resistance of a flow path from the first flow path to the second flow path through the first pressure chambers and a flow resistance of a flow path from the first flow path to the second flow path through the second pressure chambers are made same.

12. The liquid ejection head according to claim 11, further comprising:

a plurality of pressure chamber groups in each of which the first pressure chamber row and the second pressure chamber row are adjacent to each other to form two rows, wherein the plurality of pressure chamber groups are disposed to overlap the first flow path and the second flow path, respectively, as viewed from the ejection direction.

* * * * *